US012104460B1

(12) United States Patent
Song et al.

(10) Patent No.: US 12,104,460 B1
(45) Date of Patent: Oct. 1, 2024

(54) FULL-BORE INDEFINITE-LEVEL STAGED FRACTURING SLIDING SLEEVE BASED ON SMART LABEL AND IMPLEMENTATION METHOD THEREOF

(71) Applicant: Ningbo Huaao intelligent equipment Co., LTD, Yuyao (CN)

(72) Inventors: Wenping Song, Harbin (CN); Duoli Zhang, Harbin (CN); Jun Yang, Harbin (CN); Fenglong Li, Harbin (CN); Huapeng Wang, Harbin (CN)

( * ) Notice: Subject to any disclaimer, the term of this patent is extended or adjusted under 35 U.S.C. 154(b) by 0 days.

(21) Appl. No.: 18/384,834

(22) Filed: Oct. 27, 2023

Related U.S. Application Data

(63) Continuation of application No. PCT/CN2023/090719, filed on Apr. 26, 2023.

(51) Int. Cl.
*E21B 34/14* (2006.01)
*E21B 43/26* (2006.01)

(52) U.S. Cl.
CPC ..... *E21B 34/14* (2013.01); *E21B 43/26* (2013.01); *E21B 2200/06* (2020.05); *E21B 2200/08* (2020.05)

(58) Field of Classification Search
CPC .. E21B 34/14; E21B 2200/06; E21B 2200/08; E21B 43/26
See application file for complete search history.

(56) References Cited

U.S. PATENT DOCUMENTS

| | | | | |
|---|---|---|---|---|
| 11,808,124 | B1 * | 11/2023 | Shetty | E21B 43/2607 |
| 2013/0168099 | A1 * | 7/2013 | Themig | E21B 34/103 166/308.1 |
| 2015/0218923 | A1 * | 8/2015 | Hallundbæk | E21B 43/27 166/305.1 |
| 2016/0251923 | A1 * | 9/2016 | Keerthivasan | E21B 43/14 166/383 |

FOREIGN PATENT DOCUMENTS

| | | | |
|---|---|---|---|
| CN | 105822278 | A | 10/2018 |
| CN | 110593837 | A | 5/2020 |
| CN | 113404477 | A | 9/2021 |
| CN | 113356794 | A | 12/2021 |

* cited by examiner

*Primary Examiner* — Dany E Akakpo
(74) *Attorney, Agent, or Firm* — Daniel M. Cohn; Howard M. Cohn

(57) ABSTRACT

The application provides a full-bore infinite-level staged fracturing sliding sleeve based on a smart label, which includes a fracturing sliding sleeve and a smart label for opening the fracturing sliding sleeve. The fracturing sliding sleeve is placed into a wellbore with a casing and cementing is performed. Each fracturing sliding sleeve corresponds to a target fracturing stage in the well. The smart label is placed into the casing through a wellhead, and is pumped forwards in the wellbore; the smart label automatically identifies the target fracturing stage, and is clamped and seated in the fracturing sliding sleeve of the target fracturing stage, thus realizes the opening of the fracturing sliding sleeve with the pressure from a pump truck. The opening of the fracturing sliding sleeve of each stage corresponds to a smart label.

(Continued)

After all the stages are fractured, the smart labels are completely dissolved in the fracturing fluid.

9 Claims, 4 Drawing Sheets

FULL-BORE INDEFINITE-LEVEL STAGED FRACTURING SLIDING SLEEVE BASED ON SMART LABEL AND IMPLEMENTATION METHOD THEREOF

TECHNICAL FIELD

The present application relates to the technical field of oil and gas field development, in particular to a full-bore infinite-level staged fracturing sliding sleeve based on a smart label and an implementation method thereof.

BACKGROUND

The multi-stage fracturing technology of horizontal wells is the key to the development of oil and gas fields. As the three major technology series, the pumped bridge plug and perforation staged fracturing technology, the multi-level sliding sleeve packer staged fracturing technology, and the hydraulic jet staged fracturing technology provide strong technical support to increase the transformation effect of oil and gas field reservoirs and effectively use the oil and gas field reservoirs on a large scale.

At present, the main staged fracturing mode of oil and gas fields at home and abroad is the pumped bridge plug and perforation technology, which can meet the construction needs of large fluid volume and large displacement, has a unlimited number of pumped perforation fracturing stages, and can carry out large-scale sand fracturing. However, when using the pumped bridge plug and perforation technology, the construction time is long, the ground cross operation is complicated, and cable breakage and tool falling accidents are easy to occur when the tools encounter obstacles. As a result, synchronous fracturing and zipper fracturing cannot be implemented smoothly, which greatly affects the efficiency of the fracturing construction. The multi-level sliding sleeve packer staged fracturing technology enters the sliding sleeve tool with the casing in the horizontal section cementing, and the fracturing of each stage is carried out by opening the sliding sleeve through the coiled tubing dragging or ball. Although the indefinite-level fracturing sliding sleeve performed by the coiled tubing dragging can achieve a full-bore effect, due to the limitation of the size of the coiled tubing and the packer tool in the well during fracturing, the fracturing construction displacement is limited. In the ball sliding sleeve staged fracturing, due to the existence of the difference of the ball seats of different stages, a diameter of the sliding sleeve gradually decreases as the sliding sleeve moves downwards, thus, the number of fracturing stages is limited. In the hydraulic jet staged fracturing technology, the wellhead pressure is high, the construction safety risk is high, and the displacement and sanding scale are limited.

SUMMARY

The present disclosure aims to provide a full-bore indefinite-level staged fracturing sliding sleeve based on a smart label and an implementation thereof, which can achieve large-bore, full-bore, indefinite-level staged fracturing in a well.

In an aspect, the present disclosure provides a full-bore indefinite-level staged fracturing sliding sleeve based on a smart label; the fracturing sliding sleeve includes an outer housing (203), a sandblasting port (204) arranged on the outer housing (203), an identification module (202) arranged in the outer housing (203) for indicating an address of a fracturing sliding sleeve of the current stage, and a valve core (205) driven by a smart label to move horizontally to open and close the sandblasting port (204), the smart label is capable of identifying the identification module (202) to be clamped and seated at the valve core (205);

the smart label includes an outer housing (101), and a detection module (107) arranged in the outer housing (101) for identifying the identification module (202) to automatically determine a target fracturing stage;

the sliding sleeve further includes a gripper (103) mounted inside the outer housing (101), an execution module (104) triggered by the detection module (107) and connected with the gripper (103), a sealing cylinder (106) mounted on an outer surface of the outer housing (101), and a pressing sleeve (105) mounted on the outer housing (101) and located on a left side of the sealing cylinder (106);

when the detection module (107) determines that the identification module (202) is in a target opening stage, the execution module (104) is triggered to drive the gripper (103) to expand and the pressing sleeve (105) to move rightwards such that the sealing cylinder (106) expands; the sealing cylinder (106) engages with an inner wall of the valve core (205), and the gripper (103) engages with an inner wall of the outer housing (203).

In another aspect, the present disclosure further provides an implementation method of the above full-bore indefinite-level staged fracturing sliding sleeve based on a smart label, including:

step S1, the fracturing sliding sleeve entering a wellhead with a casing (4), and a number and position of the fracturing sliding sleeve corresponding to a number and position of each fracturing stage in a well;

step S2, the smart label controlling a target fracturing stage through a ground controller, then the smart label being placed through a wellhead and being umped forward by a ground fracturing vehicle set, and the detecting module (107) detecting the identification module (202) in the fracturing sliding sleeve of each stage in the process of being pumped forwards;

step S3, when the detecting module (107) determines that the current fracturing sliding sleeve is the fracturing sliding sleeve of the target fracturing stage, the gripper (103) extending out, the sealing cylinder (106) expanding, and the smart label driving the valve core (205) to move rightwards under the action of pumping pressure to open the sandblasting port (204) such that the fracturing sliding sleeve is opened.

BRIEF DESCRIPTION OF THE DRAWINGS

In order to explain the technical solutions in the embodiments of the present disclosure or the prior art more clearly, the drawings used by the description of the embodiments or the prior art will be briefly introduced below. Obviously, the drawings in the following description may be merely some embodiments of the present disclosure. For those of ordinary skilled in the art, other drawings may be obtained according to the structures shown in the drawings without creative effort.

The realization of the purpose, functional features and advantages of the present application will be further described with reference to the accompanying drawings in conjunction with the embodiments.

DETAILED DESCRIPTION OF THE EMBODIMENTS

In the following, the technical solutions in the embodiments of the present disclosure will be clearly and completely described with reference to the drawings in the embodiments of the present disclosure. Obviously, the described embodiments may be only a part of the embodiments of the present disclosure, but not all of the embodiments. Based on the embodiments of the present disclosure, all other embodiments obtained by those of ordinary skilled in the art without creative effort shall fall within the protection scope of the present disclosure.

A full-bore infinite-level staged fracturing sliding sleeve based on a smart label includes a smart label 1 and a full-bore infinite-level staged fracturing sliding sleeve 2 (hereinafter as "fracturing sliding sleeve 2").

Figure 4:
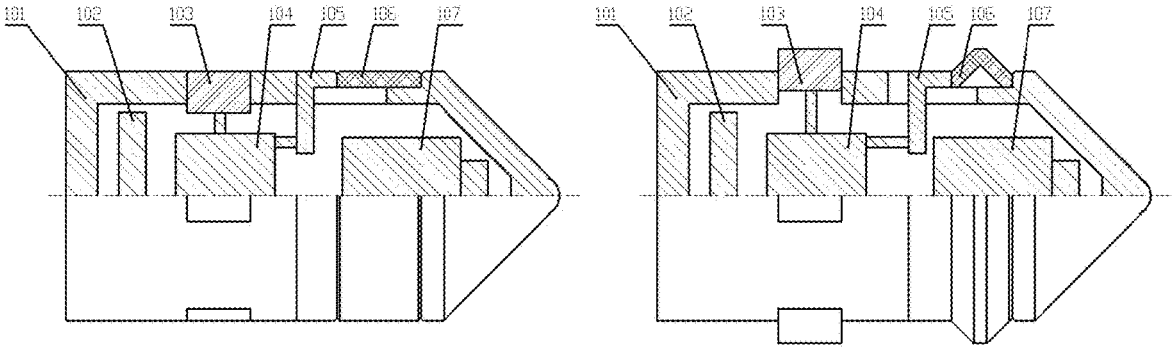
FIG. 4 shows an initial state, a clamping state, and a seated state of the smart label.

As shown in FIG. 4, the smart label 1 includes an outer housing 101, a power supply 102, at least one gripper 103, an execution module 104, a pressing sleeve 105, a sealing cylinder 106, and a detection module 107.

Figure 1:
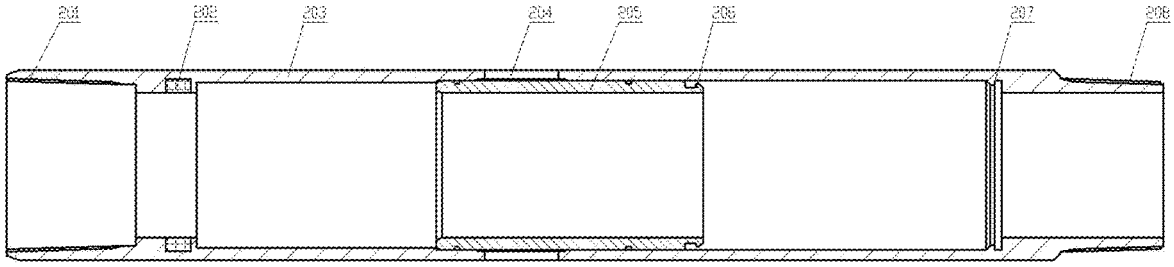
FIG. 1 is a schematic view of a full-bore indefinite-level staged fracturing sliding sleeve in a closed state in accordance with an embodiment of the present disclosure.
Figure 2:
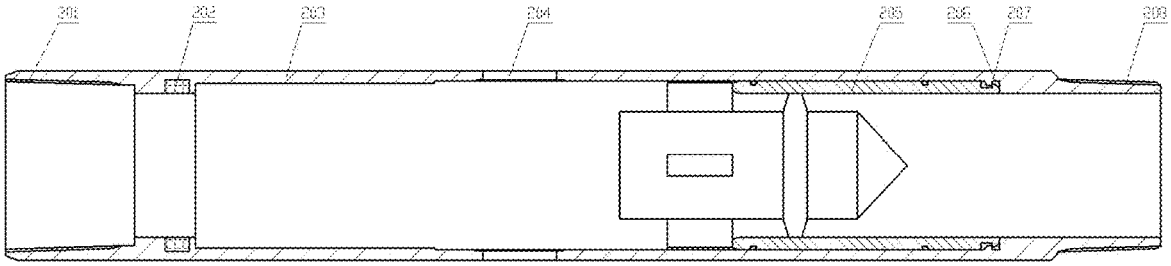
FIGS. 2 and 3 respectively show the closed state and an open state of the full-bore infinite-level staged fracturing sliding sleeve based on a smart label.
Figure 3:
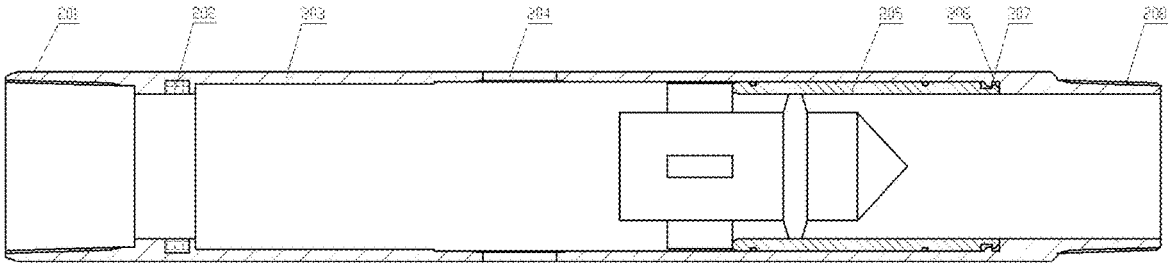

As shown in FIGS. 1 to 3, the fracturing sliding sleeve 2 includes an upper connector 201, an identification module 202, an outer housing 203, a sandblasting port 204, a valve core 205, a clamping mechanism 206, a limiting slot 207, and a lower connector 208.

In the smart label 1, the power supply 102 is mounted in the outer housing 101, which is used to supply power to the execution module 104 and the detection module 107.

A mounting slot is formed in the outer housing 101. The at least one gripper 103 is evenly arranged in the mounting slot along a circumferential direction and is connected to the execution module 104 inside the outer housing. When being driven by the execution module 104, the gripper 103 can expand outwards to engage with an inner wall of the outer housing 203, such that the gripper 103 can be clamped in a target sliding sleeve and engage with the target sliding sleeve to be locked at the valve core 205.

An annular groove is formed in a surface of the outer housing 101. The annular groove is located on a right side of the mounting slot, the sealing cylinder 106 is mounted in the annular groove, and the pressing sleeve 105 is arranged on a left side of the sealing cylinder 106. The pressing sleeve 105 is connected with the execution module 104 inside the outer housing 101. When being driven by the execution module 104, the pressing sleeve 105 can move 30) rightwards inside the mounting slot formed in the outer housing 101 as shown in FIG. 1. When the pressing sleeve 105 moves rightwards, the pressing sleeve 105 drives the sealing cylinder 106 to expand outwards to engage with an inner wall of the valve core 205, thus, the sealing cylinder 106 can be seated in the valve core 205 to block a casing 4.

The detection module 107 is arranged in the outer housing 101 to identify the identification module 202 in the fracturing sliding sleeve and determines whether the identification module 202 is in a target opening stage.

A driving force of the execution module 104 can be a high gas pressure produced by a detonation of gunpowder, a linear pushing force provided by an electric push rod, or an expansion force provided by a motor torque.

The smart label as a whole is made of soluble material such as magnesium aluminum alloy, which can be completely dissolved in a certain period of time by being immersed in fracturing fluid containing salt solution.

The smart label 1 is placed into the casing 4 through a wellhead, and is driven to move forwards in a wellbore by pumping. The smart label 1 automatically identifies the fracturing sliding sleeve of a target stage and is clamped and seated in the fracturing sliding sleeve of the target stage. The smart label 1 applies pressure to the fracturing sliding sleeve of the target stage by a pump truck to open the fracturing sliding sleeve, and thus the fracturing sliding sleeve is fractured level by level from the bottom to the top. The opening of the fracturing sliding sleeve of each stage corresponds to one smart label 1. From the back to the front, the opening and fracturing of the fracturing sliding sleeve of each stage are completed level by level through repeated placement of smart labels and fracturing operations. After all the stages are fractured, the smart label is completely dissolved by being immersed in the fracturing fluid, and there is no metal fragment residue in the wellbore, which does not cause damage to the production tools in the subsequent wellbore.

The smart label 1 is initially in the state shown in the left side of FIG. 4. The detection module 107 is used to position and identify the identification module 202. When the detection module 107 determines that the identification module 202 of the current fracturing sliding sleeve is in the target opening stage, the detection module 107 triggers the execution module 104. The execution module 104 drives the gripper 103 and the sealing cylinder 106 to expand to be in the state shown in the right side of FIG. 4, in which the gripper 103 and the sealing cylinder 106 are clamped and seated in the fracturing sliding sleeve.

In the fracturing sliding sleeve 2, the upper connector 201 and the lower connector 208 are respectively arranged on a left end and a right end of the outer housing 203. The fracturing sliding sleeve 2 is connected to an upper part of the casing 4 through the upper connector 201, and is connected to a lower part of the casing 4 through the lower connector 208.

The valve core 205 is mounted inside the outer housing 203. As shown in FIG. 1, when the valve core 205 is in a closed state, the valve core 205 blocks the sandblasting port 204 evenly arranged in the outer housing 203 in the circumferential direction, and the casing 4 does not communicate with the formation at this time.

The identification module 202 is mounted inside the outer housing 203 and is adjacent to the upper connector 201. The identification module 202 indicates an address of the fracturing sliding sleeve of the current stage. When the smart label 1 determines that the identification module 202 of the current fracturing sliding sleeve is in the target opening stage through the detection module 107, the smart label 1 is clamped and seated at the valve core 205 of the fracturing sliding sleeve 2, which is as shown in FIG. 2. Then, with the pressure from the ground pump truck, the smart label 1 drives the valve core 205 to move rightwards as shown in FIG. 2 or FIG. 3, such that the valve core 205 can break away from the sandblasting port 204, and the fracturing sliding sleeve is opened.

The clamping mechanism 206 is arranged on the valve core 205. When the fracturing sliding sleeve 2 is opened in place, the clamping mechanism 206 is clamped to the limiting slot 207 arranged in one side of the upper connector 201 adjacent to the lower connector 208, thus, the fracturing sliding sleeve 2 is locked in the open state as shown in FIG. 3 and is prevented from being closed again.

The fracturing sliding sleeve moves into the wellbore with the casing 4 and cementing is performed, and each fracturing sliding sleeve corresponds to a target fracturing stage in the well.

An implementation method of the full-bore indefinite-level staged fracturing sliding sleeve includes steps as follows.

Step S1, setting a stage number of the fracturing sliding sleeve 2; after the fracturing sliding sleeve and a last toe-end sliding sleeve 3 enter the wellbore with the casing 4 and the cementing is performed, applying pressure through a pumper at the wellhead to open the toe-end sliding sleeve 3, and thus building a pumping delivery channel. That is, the outer housing 203 enters the wellhead with the casing 4, and the number and position of the outer housing 203 correspond to the number and position of each fracturing stage in the well.

Figure 5:
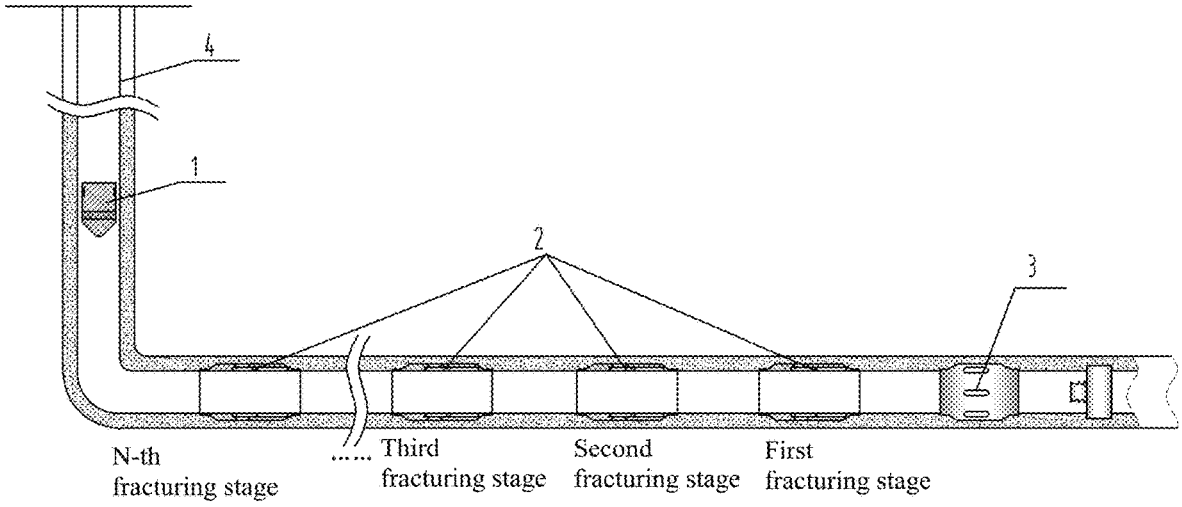
FIG. 5 to FIG. 9 show an implementation method of the full-bore infinite-level staged fracturing sliding sleeve based on a smart label.
Figure 6:
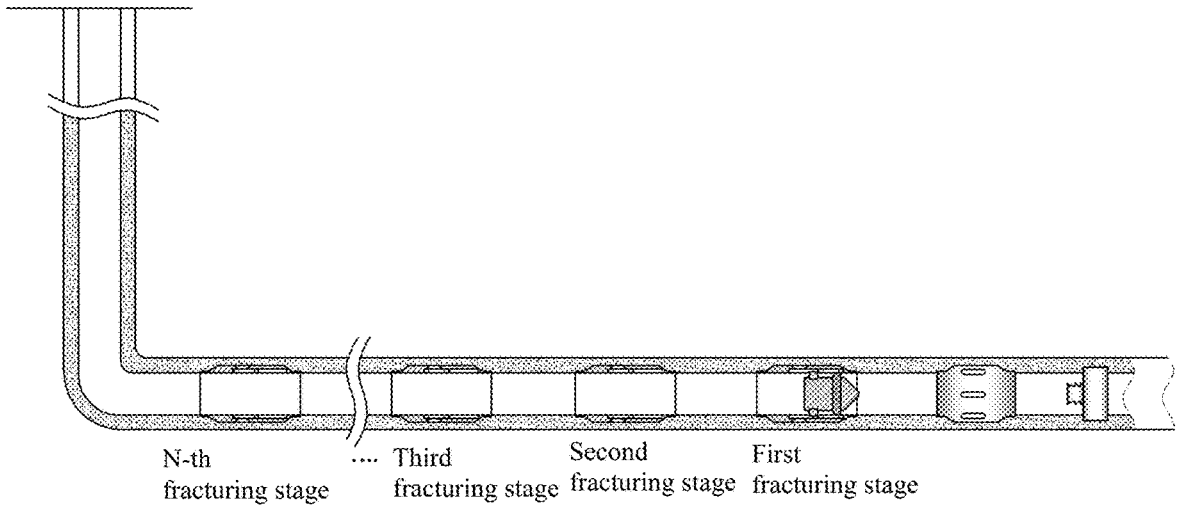

Step S2, as shown in FIG. 5 and FIG. 6, when the fracturing of a first fracturing stage is carried out, placing the smart label 1 through the wellhead and pumping the smart label 1 to the fracturing sliding sleeve corresponding to the first fracturing stage; detecting the identification module 202 in the fracturing sliding sleeve through the smart label 1; that is, the target stage is controlled by the detection module 107 through a ground controller, and the detection module 107 is placed through the wellhead and is pumped forwards through a ground fracturing vehicle. In the process of being pumped forwards, the detection module 107 detects the identification module 202 in the fracturing sliding sleeve of each stage.

Step S3, the smart label being clamped and seated in first fracturing stage, the smart label 1 applying pressure to the first fracturing stage through the pumper at the wellhead to fracture the first fracturing stage; that is, when it is determined that the current fracturing sliding sleeve corresponds to the target fracturing stage, the gripper 103 extends out and the sealing cylinder 106 expands, and the smart label 1 drives the valve core 205 to move rightwards under the action of pumping pressure to open the sandblasting port 204, thus the target fracturing stage is opened.

Figure 7:
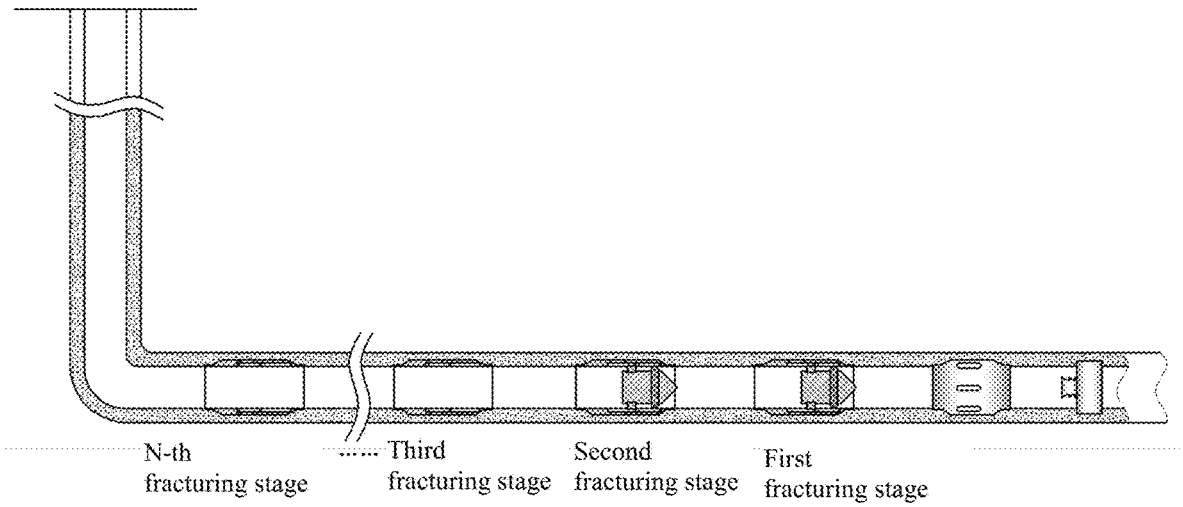
Figure 8:
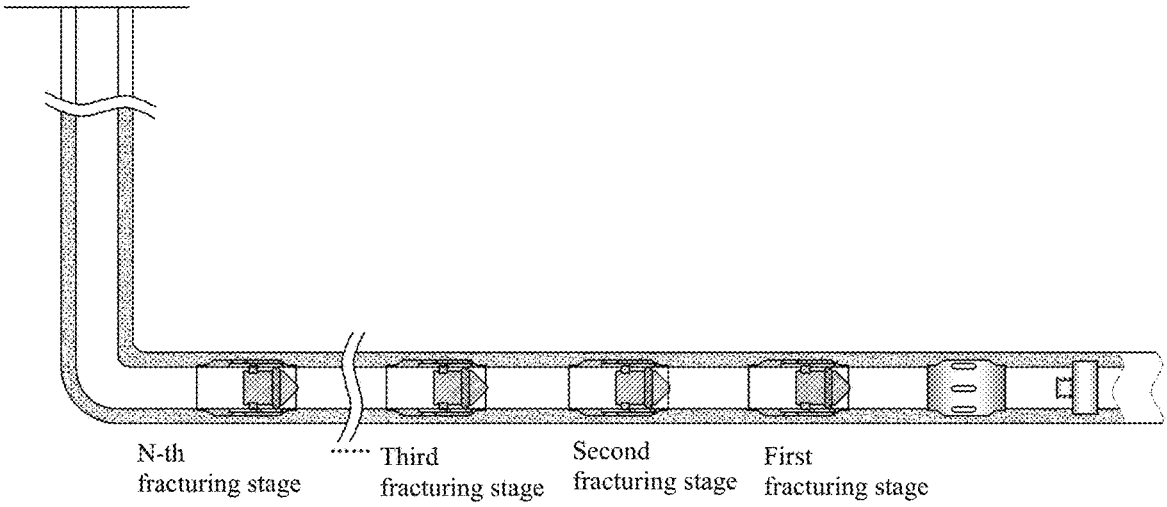

Step S4, as shown in FIG. 7 and FIG. 8, after the first fracturing stage is fractured, placing the smart label 1 capable of controlling the opening of a second fracturing stage through the wellhead again, and repeating the steps S2 and S3 to complete the fracturing of the second fracturing stage. The third fracturing stage to the N-th fracturing stage are similarly fractured, that is, the fracturing sliding sleeves of all stages are opened level by level and are fractured staged by staged through the smart label.

Figure 9:
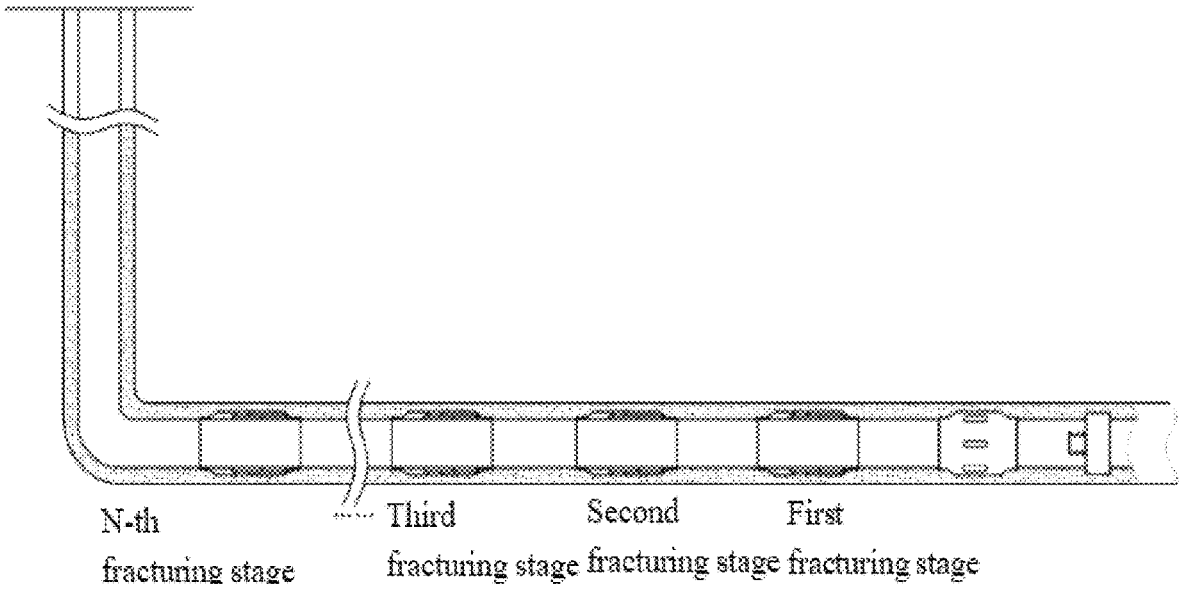

Step S5, as shown in FIG. 9, after the fracturing sliding sleeve of each stage is fractured, the smart label clamped and seated in the fracturing sliding sleeve of each stage is dissolved by being immersed in the downhole fracturing fluid, and the downhole casing and the fracturing sliding sleeve of each stage form a full-bore and large-bore flow.

The fracturing sliding sleeve has the technical characteristics of large bore, full bore and indefinite level. The opening control of the fracturing sliding sleeve in the target fracturing stage can be realized by pumping the smart label 1 through the wellhead, without electric seating tool or coiled tubing operation, and the smart label can be completely dissolved without grinding or fishing after the fracturing is completed, which meets the needs of multi-stage and large-scale fracturing, effectively improves the efficiency of fracturing construction, greatly reduces the cost of fracturing construction, and provides a strong technical support for increasing the transformation effect and large-scale effective use of oil and gas reservoirs. The full-bore indefinite-level staged fracturing sleeve 2 applied in this application has the characteristics of full bore, which can realize the staged fracturing in any length horizontal section with any stage number. The fracturing sliding sleeve of each stage can be uniquely positioned through the built-in identification module 202.

The above descriptions are only optional embodiments of the application, and do not limit the scope of the patents of the present application. All the equivalent structural transformations made by the content of the specification and drawings of the present application under the creative concept of the present application, or directly/indirectly used in other related technical fields are all included in the protection scope of the patents of the present application.

What is claimed is:

1. A full-bore infinite-level staged fracturing sliding sleeve based on a smart label, wherein the fracturing sliding sleeve comprises an outer housing (203), a sandblasting port (204) arranged on the outer housing (203), an identification module (202) arranged in the outer housing (203) for indicating an address of a fracturing sliding sleeve of the current stage, and a valve core (205) driven by a smart label to move horizontally to open and close the sandblasting port (204), the smart label is capable of identifying the identification module (202) to be clamped and seated at the valve core (205);

the smart label comprises an outer housing (101), and a detection module (107) arranged in the outer housing (101) for identifying the identification module (202) to automatically determine a target fracturing stage;

the sliding sleeve further comprises a gripper (103) mounted inside the outer housing (101), an execution module (104) triggered by the detection module (107) and connected with the gripper (103), a sealing cylinder (106) mounted on an outer surface of the outer housing (101), and a pressing sleeve (105) mounted on the outer housing (101) and located on a left side of the sealing cylinder (106);

when the detection module (107) determines that the identification module (202) is in a target opening stage, the execution module (104) is triggered to drive the gripper (103) to expand and the pressing sleeve (105) to move rightwards such that the sealing cylinder (106) expands; the sealing cylinder (106) engages with an inner wall of the valve core (205), and the gripper (103) engages with an inner wall of the outer housing (203);

wherein a driving force of the execution module (104) comprises a high gas pressure produced by a detonation of gunpowder.

2. The full-bore infinite-level staged fracturing sliding sleeve based on a smart label according to claim 1, further comprising a clamping mechanism (206) arranged on the valve core (205) and a limiting slot (207) formed in the outer housing (203), and the clamping mechanism (206) can be clamped in the limiting slot (207) after the valve core (205) is opened by the smart label.

3. The full-bore infinite-level staged fracturing sliding sleeve based on a smart label according to claim 2, wherein the identification module (202) comprises a magnetic ring or a radio frequency chip.

4. The full-bore infinite-level staged fracturing sliding sleeve based on a smart label according to claim 3, wherein an upper connector (201) and a lower connector (208) are respectively arranged on both ends of the outer housing (203), the identification module (202) is located on a right side of the upper connector (201), and the limiting slot (207) is located on a left side of the lower connector (208); the valve core (205) is located between the identification module (202) and the limiting slot (207); when the valve core (205) moves rightwards, the sandblasting port (204) is opened, and when the valve core (205) moves leftwards, the sandblasting port (204) is closed; and the smart label enters the outer housing (203) through the upper connector (201).

5. The full-bore infinite-level staged fracturing sliding sleeve based on a smart label according to claim 1, wherein the detection module (107) is capable of performing magnetic positioning or radio-frequency positioning identification through a Hall element or a radio frequency antenna.

6. The full-bore infinite-level staged fracturing sliding sleeve based on a smart label according to claim 1, further comprising a power supply (102) arranged in the outer housing (101) to supply power to the execution module (104) and the detection module (107).

7. The full-bore infinite-level staged fracturing sliding sleeve based on a smart label according to claim 1, wherein the smart label as a whole is made of soluble material; after fracturing operation is completed, the smart label is dissolved by being immersed in well fluid.

8. The full-bore infinite-level staged fracturing sliding sleeve based on a smart label according to claim 1, wherein the identification module (202) comprises a magnetic ring or a radio frequency chip.

9. An implementation method of the full-bore indefinite-level staged fracturing sliding sleeve based on a smart label of claim 1, comprising: step S1, the fracturing sliding sleeve entering a wellhead with a casing (4), and a number and position of the fracturing sliding sleeve corresponding to a number and position of each fracturing stage in a well;

step S2, the smart label controlling a target fracturing stage through a ground controller, then the smart label being placed through the wellhead and being pumped forward by a ground fracturing vehicle set, and the detecting module (107) detecting the identification module (202) in the fracturing sliding sleeve of each stage in the process of being pumped forwards;

step S3, when the detecting module (107) determines that the current fracturing sliding sleeve is the fracturing sliding sleeve of the target fracturing stage, the gripper (103) extending out, the sealing cylinder (106) expanding, and the smart label driving the valve core (205) to move rightwards under the action of pumping pressure to open the sandblasting port (204) such that the fracturing sliding sleeve is opened;

wherein a driving force of the execution module (104) comprises a high gas pressure produced by a detonation of gunpowder.

* * * * *